US010041249B1

(12) United States Patent
Hebert et al.

(10) Patent No.: US 10,041,249 B1
(45) Date of Patent: Aug. 7, 2018

(54) ADJUSTABLE BARRIER FOR PARTITIONING A BUILDING SPACE

(71) Applicants: Timothy Hebert, Lewiston, ME (US); Bruce Bickford, Cushing, ME (US)

(72) Inventors: Timothy Hebert, Lewiston, ME (US); Bruce Bickford, Cushing, ME (US)

( * ) Notice: Subject to any disclaimer, the term of this patent is extended or adjusted under 35 U.S.C. 154(b) by 0 days.

(21) Appl. No.: 15/224,614

(22) Filed: Jul. 31, 2016

Related U.S. Application Data

(60) Provisional application No. 62/207,891, filed on Aug. 20, 2015, provisional application No. 62/199,860, filed on Jul. 31, 2015.

(51) Int. Cl.
*E04B 2/72* (2006.01)
*E04B 2/82* (2006.01)
*E06B 11/00* (2006.01)

(52) U.S. Cl.
CPC ..... *E04B 2/721* (2013.01); *E04B 2/82* (2013.01); *E04B 2/828* (2013.01); *E06B 11/00* (2013.01)

(58) Field of Classification Search
CPC . E04B 2/721; E04B 2/82; E04B 2/828; E06B 11/00
See application file for complete search history.

(56) References Cited

U.S. PATENT DOCUMENTS 2,855,037 A * 10/1958 Stiffel ..... E04L 32/7438 15/268
3,593,474 A * 7/1971 Neels ..... B44C 3/12 52/223.7
3,596,701 A * 8/1971 Cowan ..... G09F 15/0068 160/135
3,685,223 A * 8/1972 Sherwood ..... E04B 2/827 49/127
3,897,668 A * 8/1975 McDonnell ..... E04L 32/822 248/200.1
4,144,924 A * 3/1979 Vanden Hoek ..... E04L 32/7429 160/231.2
4,245,442 A * 1/1981 Durham ..... E04L 32/7455 52/126.4
4,277,920 A * 7/1981 Dixon ..... E04L 32/824 49/321
4,535,577 A * 8/1985 Tenser ..... E04B 2/7429 174/495
4,546,889 A * 10/1985 Schoumaker ..... E04L 32/7444 211/105.3

(Continued)

FOREIGN PATENT DOCUMENTS

EP 0821113 1/1998

*Primary Examiner* — James M Ference
(74) *Attorney, Agent, or Firm* — G. Nessler

(57) ABSTRACT

A wall for partitioning space within a building comprises interconnected barriers. For adjustable height, each barrier comprises a lower panel and a slidable and overlapping upper panel. Barriers are interconnected at vertical edges by a combination of rigid pins and slots or by hinge assemblies. Mating male and female parts of a hinge assembly attach to both panels of adjacent barriers with adjustable heights, and enable selective angling of barriers relative to each other. A filler barrier, for filling a space along a wall that is less or more wide than a standard width barrier, has sliding inter-nested frame parts that attach to the two panels of a standard barrier. A clip secures the top of a barrier to the grid of a suspended ceiling.

13 Claims, 8 Drawing Sheets

(56) References Cited

U.S. PATENT DOCUMENTS 4,706,551 A * 11/1987 Schofield ..... B08B 15/026 135/117
4,731,961 A * 3/1988 Bona ..... E04B 2/82 135/142
4,833,840 A * 5/1989 Kalischewski ..... E04B 2/82 160/197
5,054,255 A * 10/1991 Maninfior ..... E04L 32/7425 52/239
5,088,511 A * 2/1992 Bain ..... B08B 15/026 134/200
5,125,202 A * 6/1992 Kissinger ..... E04B 2/82 49/372
5,433,046 A * 7/1995 MacQuarrie ..... E04L 32/7422 52/238.1
5,457,922 A * 10/1995 Fara ..... E04G 21/24 312/1
5,685,112 A * 11/1997 Fara ..... E04G 21/24 312/1
5,803,653 A * 9/1998 Zuffetti ..... E04L 32/7457 248/188.5
5,816,001 A * 10/1998 Goodman ..... A47B 57/425 52/220.7
5,924,469 A * 7/1999 Whittemore ..... A47H 21/00 160/351
6,266,939 B1 * 7/2001 Yates ..... E04F 21/00 52/741.1
6,383,242 B1 * 5/2002 Rogers ..... B01D 46/42 454/63
6,435,253 B1 * 8/2002 Steeves ..... A47G 5/00 160/135
6,662,502 B2 * 12/2003 Janutta ..... E05D 15/0608 49/127
6,729,085 B2 * 5/2004 Newhouse ..... B25B 5/003 52/239
7,188,636 B1 * 3/2007 Kanne ..... B08B 15/02 135/142
7,461,484 B2 * 12/2008 Battey ..... E04B 2/7425 52/220.7
7,810,771 B1 * 10/2010 Akers ..... E04G 21/24 160/368.1
8,046,957 B2 * 11/2011 Towersey ..... E04L 32/7424 52/127.6
8,074,700 B1 * 12/2011 Melino ..... E04G 21/30 160/327
8,839,592 B2 9/2014 Foran
8,875,772 B1 * 11/2014 Dixon, Jr. ..... A63B 71/022 160/180
8,875,774 B1 * 11/2014 Flores ..... E04G 21/30 160/351
2002/0152703 A1 * 10/2002 Dunks ..... E04L 32/7416 52/506.01
2003/0024189 A1 * 2/2003 Hughes ..... E04G 21/24 52/271
2004/0065799 A1 * 4/2004 Whittemore ..... E04G 21/30 248/354.1
2006/0283562 A1 * 12/2006 Hickey ..... E04G 21/30 160/180
2009/0020242 A1 * 1/2009 Muhlebach ..... E04G 21/30 160/376
2009/0133354 A1 * 5/2009 Spear ..... E04B 2/7453 52/588.1
2009/0307990 A1 * 12/2009 Muehlebach ..... E04B 2/822 52/63
2010/0058688 A1 * 3/2010 Goddard ..... E04L 32/7433 52/238.1
2011/0078960 A1 * 4/2011 Luttmann ..... E04B 2/827 52/64
2011/0138719 A1 * 6/2011 Gosling ..... E04L 32/7405 52/284
2012/0006498 A1 * 1/2012 Potter ..... A01K 1/035 160/127
2014/0033642 A1 * 2/2014 Foran ..... E04G 21/30 52/782.1
2014/0075851 A1 * 3/2014 Rhines ..... E04L 32/72 52/63

* cited by examiner

ADJUSTABLE BARRIER FOR PARTITIONING A BUILDING SPACE

This application claims benefit of provisional application Ser. No. 62/199,860, filed Jul. 31, 2015 and provisional application Ser. No. 62/207,891, filed Aug. 20, 2015, the disclosures of which are hereby incorporated by reference.

TECHNICAL FIELD

The present invention relates to barriers and associated accessories, for creating a wall that partitions space within a building or the like.

BACKGROUND

When construction work associated with remodeling a building's interior space is being carried out, it is often desirable to maintain the functionality and cleanliness of interior space which is spaced apart from the area being worked on by setting up a temporary barrier to partition the building space. Often it is necessary to provide doors for passage through the barrier.

In the past, practices for doing this have included so-called soft barriers, which are essentially plastic sheeting that is fastened to existing walls and temporary studs, rafters and floor plates, and so-called hard barriers, which are light duty walls made of wood or gypsum board panels that are attached to temporary framing attached to the walls, ceiling and floor. The latter typically have a more pleasing appearance and are sturdier. However, installing such barriers can involve construction noise and dust, which is undesirable.

Thus, temporary and re-usable factory-manufactured barriers have been used commercially. U.S. Pat. No. 8,839,592 of Foran describes a prefabricated barrier system in which a lower panel has an attached upper panel that adjusts vertically, to make the height of the barrier fit the height of the space being partitioned.

One of the problems encountered with such kind of prefabricated and reusable barrier is how to engage the barrier with a drop ceiling, because of difficulty with applying effective upward force, an aim to avoid moving a ceiling tile which might lead to dust and debris contamination.

Another need is for a wall system which is adapted to running along an irregular path, as compared to a straight line path and possible right angle corners. A further need is to cope readily with temporary wall lengths which are not an even multiple of the widths of individual interconnected panels which form the temporary wall. Any improved wall system should capable of being easily assembled and disassembled and should be durable.

SUMMARY

Figure 1:
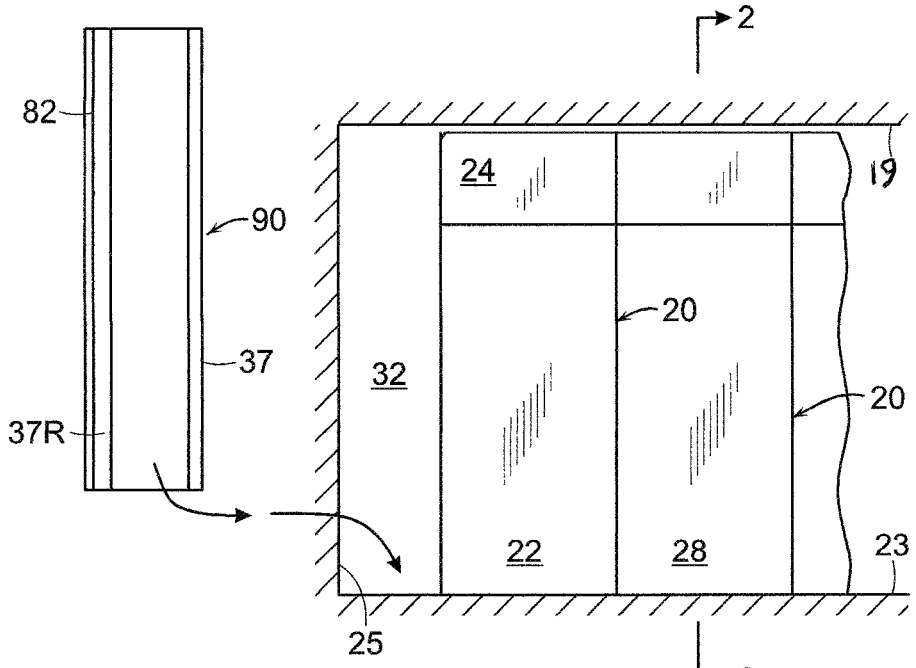
FIG. 1 is a front view of an assembly of several barriers, positioned within an interior space opening of a building, along with a filler barrier shown in exploded position, with an arrow showing how the filler piece will fill the opening

An object of the invention is to provide a wall system comprised of a plurality of barriers which can be mated with each other to form a partition-wall which is optionally straight or has selected angled portions and which is amenable to different partition heights and lengths. Another object is to provide an improved pre-fabricated wall system which is secure; which can be installed quickly and efficiently with limited or no custom fabrication of components; and, which can be removed and reused. A further object is to provide a multi-piece barrier system which is of pleasing appearance and good fit, which is durable and has structural integrity, and which minimizes migration of dust and the like.

In accord with the invention an embodiment of barrier assembly comprises a multiplicity of barriers, each barrier comprising a lower panel and an upper panel, each panel slidably attached in overlap fashion to the other for adjustable length (i.e., barrier height, when installed). The connectors which permit slidable vertical motion of the panels relative to each other are preferably spaced apart rails on one panel that are engaged with grooves on a mated panel. In accord with the invention, an embodiment of barrier has opposing lengthwise side edges and there is a plurality of pins on one edge of a first barrier which mate with and engage with a plurality of slots on the other lengthwise edge of an adjacent like-barrier.

In further accord with invention embodiments, a hinge assembly connects a first barrier with an adjacent second barrier. Each barrier comprises a lower panel and an overlapping upper panel that is vertically movable relative to the lower panel, to change the height (vertical length) of the barrier. A hinge assembly comprises a female part comprising a gudgeon and a male part comprising a pintle that is shaped to fit within the gudgeon. The female part of the hinge comprises a first piece and a second piece which are slidably attached to each other for relative motion parallel to the length of the barrier. The first piece of the female part has a flange attached to the upper panel of a barrier and the second piece has a flange attached to the lower panel. Correspondingly, the male part of the hinge comprises a first piece and a second piece which are slidably attached to each other for relative motion parallel to the length of the barrier. The first piece of the male part has a flange for attachment to an upper panel of the adjacent second barrier and the second piece has a flange for attachment to the lower panel of the second barrier. The foregoing arrangement permits selective angling of the barriers relative to each other in a first arc range, exemplarily 90 to 175 degrees. The hinge assembly may be alternatively attached, where the assembly is "upside down" compared to what was just recited. That permits the panels of a barrier to be selectively angled in a direction which is in mirror-angle direction to the first arc range.

In further accord with the invention, a barrier assembly in accord with that just described comprises a filler assembly that is sized to fill a space having a width which is less or greater than the width of an additional "standard (width) barrier." In accord with the invention, a filler assembly comprises a frame, or a pair of opposing side frames, and a filler panel. The filler panel which may be in more than one piece, has a length that is nominally equal to the height of the barrier to which it is attached. The filler panel is captured between the one or two frames, as applies. The flange of one frame is attached to the lengthwise edge of a standard barrier. In an example, each frame comprises (a) a shoe having a flange for attachment to the edge of an upper panel of a standard barrier, the shoe having spaced apart legs; and (b) a channel, slidably captured within the legs of the shoe, the channel having a flange for attachment to the edge of a lower panel of a standard barrier. The frame shoe and channel can be adjusted so it has a length that is nominally equal to the length of the barrier to which it is attached.

In further accord with the invention, a clip attaches a ceiling channel to the grids/rails of a drop-down ceiling. The upper panel of a barrier is received in the channel and the multi-part clip grips with clamping action the edges of a ceiling grid piece, and enables the wall to run at a chosen oblique angle to the length of the grid piece.

The foregoing and other objects, features and advantages of the present invention will become more apparent from the following description of preferred embodiments and accompanying drawings.

DESCRIPTION

The present invention represents improvements in factory-manufactured barriers and how they are connected to each other and how they are connected to the features of the space being partitioned. The disclosures of provisional application Ser. No. 62/199,860, filed Jul. 31, 2015 and provisional application Ser. No. 62/207,891, filed Aug. 20, 2015 are hereby incorporated by reference.

Figure 2:
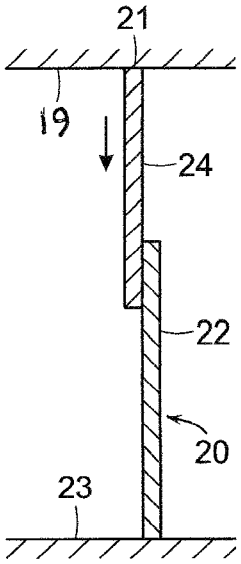
FIG. 2 is a side cross section view of the barrier assembly of FIG. 1.
Figure 3:
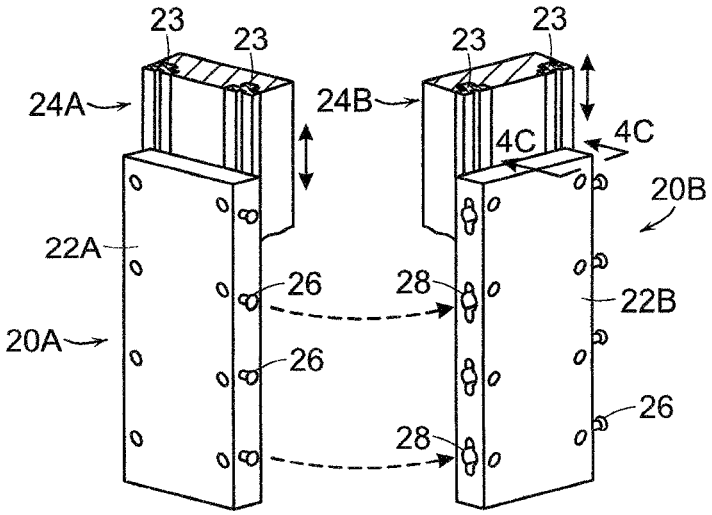
FIG. 3 is an exploded view showing how two barriers connect side-by-side with each other at a vertical joint.

FIG. 1 is a front view of a plurality of barriers 20 of the present of invention, which are configured as a wall system for partitioning, dividing, separating or defining a space within a building or in some other place. FIG. 2 is a vertical cross section of a barrier 20. FIG. 1 shows a portion of the cross section of an interior building space having floor 23, ceiling 19, and side wall 25, with three exemplary barriers of the present invention installed. The height of a typical ceiling of a commercial building will be about 9 feet from the floor and an exemplary barrier 20 will extend to such height. An exemplary barrier 20 will have a width of about 42 inches. Here a barrier which is one of several having the same width dimension and an adjustable height dimension is called a standard (width) barrier. FIG. 1 shows that an opening 32 which is less wide than a standard width barrier remains; such an opening has what is called here a non-standard width. The curved arrow line in FIG. 1 illustrates how a filler barrier 90 is be placed in the opening 32 to complete the wall.

An exemplary barrier 20 will have a lower panel 22 that has a height of about 82 inches; when the upper panel is fully extended the barrier will be about 123 inches high and there will be about 6 inches overlap of the lower panel. The height of a barrier (or one of its component panels) in this description is sometimes also referred to as the (vertical) length of the barrier/panel. Exemplary panels are rectangular and preferably have surfaces which on one side at least—preferably both—are substantially planar, optionally with texturing or decoration.

Each barrier 20 is comprised of a lower panel 22 and an upper panel 24 that is slidably attached in overlap fashion to the lower part, so the vertical height of the barrier can be adjusted to the ceiling height. Preferably, there will be soft elastomer strip or gasket (not shown) at the top 21 of the movable upper panel, so a good dust seal can be achieved with the ceiling, to prevent migration of dust. Similarly a pair of soft elastomer strips may be installed laterally between the upper panel 24 and lower panel 22 to reduce air leakage and dust intrusion in the joint between barriers that are fastened to each other.

The immediately following description here is about how adjacent barriers are attached to each other laterally, that is, in the widthwise direction at vertical joints. The last part of the description is about hinge, or adjustable angle, vertical joint connections between barriers. Another aspect includes a barrier (called filler barrier below) that is customized to fit the height and width of a non-standard opening. Another aspect comprises a clip, a fitting suited for attaching the top of a barrier to a drop ceiling comprised of suspended horizontal panels.

Figure 4A:
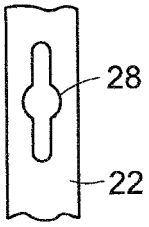
FIG. 4A is a view of a portion of the edge of a barrier showing the opening at an edge of a barrier, shaped to receive a pin from an adjacent barrier, in accord with FIG. 3.
Figure 4B:
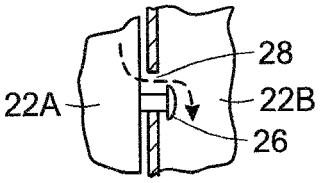
FIG. 4B is a fragmentary vertical cross section of a barrier showing how a second barrier connects, in accord with FIG. 3.
Figure 4C:
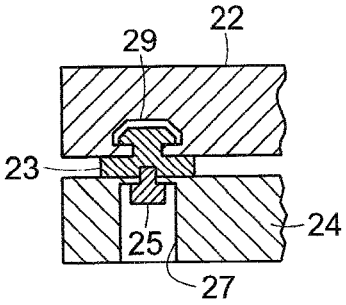
FIG. 4C is a fragmentary horizontal cross section of a portion of the right hand side barrier in FIG. 3, showing how the upper panel of a barrier mates with the lower panel of the barrier.
Figure 4D:
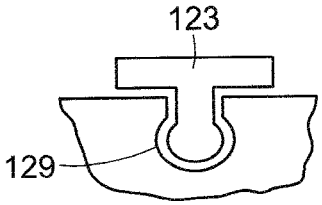
FIG. 4D is a horizontal cross section like FIG. 4C, showing an alternative slidable connector for two mated panels.
Figure 4E:
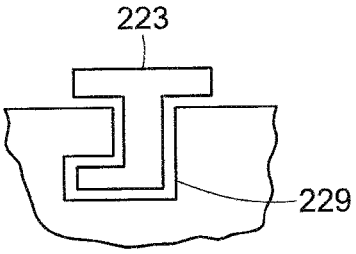
FIG. 4E is like FIG. 4D, a horizontal cross section like FIG. 4C, showing another alternative slidable connector for two mated panels.

FIG. 4C is horizontal cross section of part of two mated panels of a barrier, showing an exemplary connector 25 that slidably holds an upper panel 22 to a lower panel 24 so the length/height of a barrier can be adjusted. The connector is comprised of two components: a rail affixed to one panel and a groove in the mated overlapping panel. In the embodiment of FIG. 4C, strips 23 comprise the rails. The strips are preferably made of plastic and are attached to the face of the lower panel near the panel's opposing lengthwise edges. The strip provides a smooth rubbing surface for the upper panel to move relative to the lower panel. Each rail/strip 23 is fastened to the lower panel 24B by screws 25 which are in recesses 27. Each strip comprises a T shape cross section rail which is captured in a lengthwise groove 29 of an upper panel. The upper panel can thus move vertically relative to the strip and the lower panel. When the upper panel is raised to the desired height, it is locked in place by locking screws or clips, not shown. Other configurations of connector may be used. In the generality of the invention, a rail is shaped with a larger section size where it extends outwardly from the face of a panel, so that it may be captured within the confines of the groove. FIG. 4D is an end view of an alternative connector comprising rail 123 and slot 129, both of which have rounded cross section engagement features. FIG. 4E shows another alternative connector comprising rail 223 and a mating slot 229, both of which have L shape cross section engagement features. In the generality of the invention rails may be attached to either an upper panel or a lower panel, with grooves on the other panel. And there may be more than 2 connectors that enable vertical sliding for a given pair of mated panels.

FIG. 3, FIG. 4A, FIG. 4B and FIG. 4C illustrate the manner in which exemplary barriers 20A and 20B are connected side-by-side to each other by lengthwise joining features. Each barrier 20A, 20B comprises respective upper panels 24A, 24B and lower panels, 22A, 22B. Referring to the lower panels as examples, each panel has a plurality of spaced apart headed-pins 26 on one edge and a plurality of spaced apart openings 28 on the opposing edge, which openings are shaped to receive the headed pins of a like panel. Each opening 28 is a lengthwise slot with a larger center opening. See FIG. 4A. The dashed arrows in FIG. 3 and the dashed arrow in FIG. 4B show how the head of each pin 26 slips into the center hole of the opening 28, and then moves downwardly so the pin moves into the slot and the head of the pin is thereby captured in the opening. In the generality of this edge-to-edge joining feature of the present invention, a barrier may have an alternating line of pins and slots that mate with an alternating line of slots and pins on another barrier, or barriers may have still other arrangements or groupings or sets of pins and grooves. And in specialized cases barrier may have such joining features on only one edge.

Figure 5:
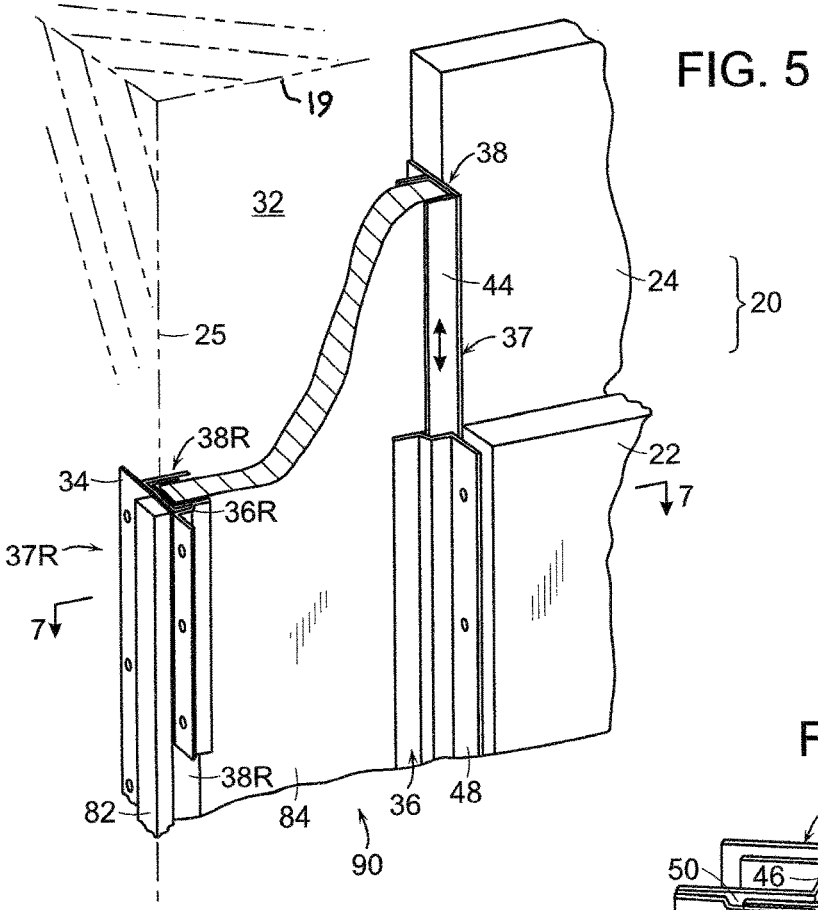
FIG. 5 shows a portion of a wall system, part of a two-panel barrier shown in FIG. 2, in combination with a partially sectioned filler barrier which is positioned within an opening.
Figure 6:
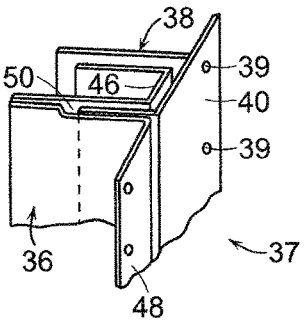
FIG. 6 is a perspective view showing how the right-side frame parts of a filler barrier shown in FIG. 5 mate with each other.
Figure 7:
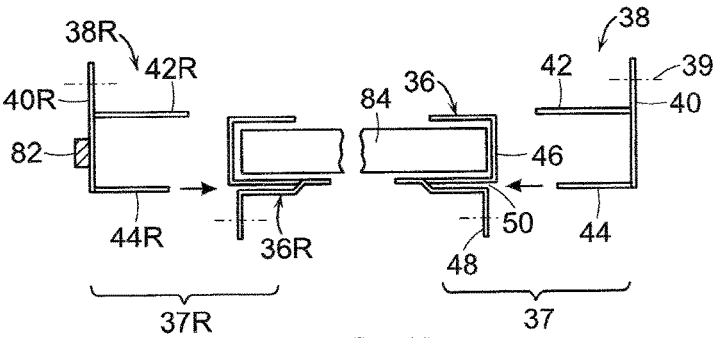
FIG. 7 is a top view, partially exploded, of the filler barrier in FIG. 5, showing the opposing-side frames (the right-side one of which is shown in FIG. 6) and the filler panel which is contained within the frames.

FIG. 5 through FIG. 7 show how an embodiment of filler barrier 90 is constructed and how it fits within a non-standard space 32 (or optionally, a standard space) while obtaining a good fit with the adjacent lengthwise edge of a string of one or more standard barriers. Filler barrier 90 comprises opposing-side frames 37, 37R that are shaped either for attachment to the edge of a standard barrier 20 or for optionally sealing against the surface of a wall 25. Each frame 37, 37R is comprised of two components, a shoe and a channel, and each frame has adjustable height. Each frame is configured to mate with a two-panel barrier 20. A filler barrier 90 comprises a filler panel 84 which is captured between the opposing-side frames 27, 37R. Panel 84 may be a single piece of gypsum board or plywood, optionally multiple pieces, which the user has cut to fit the opening 32, taking into account the presence of the frames. Opening 32 may have a width which is less or greater than the width of a standard barrier.

The top view of FIG. 7 illustrates how each frame 37, 37R is an assembly respectively of channel 38, 38R and shoe 36, 36R; a shoe moves vertically within the channel. Each shoe is shorter in length than the length of the channel in which the shoe slides. The total of the lengths of a shoe and a channel is greater than the length (height) of an opening space 32 for which the frames are intended for use.

The flange 40, 40R of each channel has holes 39 for attachment to the edge of a standard barrier or for screw-attachment to a wall. The number 39 designates the axis of a hole in this and other Figures for passage of an attachment screw or the like. Frame 37R preferably has a soft rubber gasket 82 for making a seal with a wall. See FIG. 5 and FIG. 7.

Each channel 38, 38R has respectively two spaced apart legs 42. 44 and 42R, 44R that extend outwardly respectively from flange 40, 40R. Referring to the perspective view of FIG. 6 and the right side of FIG. 7, in typical frame 37 one of the legs 44 of the channel 38 is received in a lengthwise pocket 50 of the shoe 36. Frame 37R has similar configuration.

With reference to FIG. 6 and the partial cutaway of FIG. 5, the base 46 of shoe 36 nests within the concavity of the channel 38. Thus the shoe and channel can slide vertically relative to each other. A panel which runs along the length of a shoe and channel, where the shoe is extended and only partially in overlapping engagement with the channel, fits within both the spaced apart legs of the shoe and the spaced apart legs of the channel in those portions of the frame where the shoe is not present in overlap, i.e., because it is extended upwardly or downwardly.

Figure 6A:
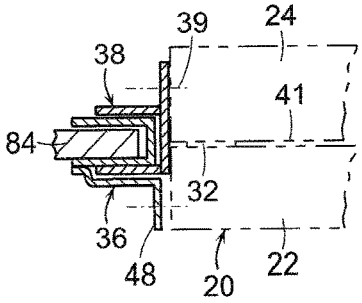
FIG. 6A is a partial horizontal cross section showing how the frame parts of a filler barrier mate with the panels of a standard barrier, shown in phantom.

FIG. 6A is a horizontal cross section through a frame, showing how the shoe attaches to the vertical edge of the lower panel 22 and the channel attaches to the vertical edge of the upper panel 24 of a standard barrier 20, shown in phantom. See also FIG. 5. Flange 48 of shoe 36 attaches to the side edge of lower panel 22 of a standard barrier and flange 40 of channel 38 attaches to the side edge of upper panel 24. The sliding motion of the channel relative to the shoe means that both the upper panel and the lower panel of a standard barrier can be fastened to the frame 37, regardless of the height to which the upper panel of the standard barrier is raised. The filler panel 84 runs the whole of the height of the opening and the length of the frame, optionally, it may be more than one piece. At the lower end of the frame the filler panel sets within the shoe; at the upper end of the frame, the filler panel sets within the channel. At the mid-height, or overlap zone of the shoe and channel, the filler panel sets within the shoe which itself sets within the concavity of the legs of the channel. Note that FIG. 5 and FIG. 6A show how the shoe and channel are sized relative to their respective flanges, so that the center of the panel 84 is nominally centered on the joint 41 between the two panels 22, 24. In typical use, the shoe and channel of a frame will be held in extended position by attachment to a barrier or a wall. Optionally, means such as clamps of locking screws may be used to secure a channel to a shoe in extended length position.

While a filler barrier preferably has two opposing-side frames, in the generality of the invention there may be a frame along only one edge of the filler, for attachment to the panels of a standard barrier, and the other side of the filler panel 84 may be either not attached to the wall, or attached by a cleat, furring strip, angle iron, or other means. While the use of filler barrier has been described in terms of putting it at the end of a string of barriers, to extend to a wall, in other uses, the filler barrier may be positioned between spaced apart standard barriers. A filler barrier of the present invention may be used with other wall systems than the two panel barrier which is described here.

As mentioned, the top end of an upper panel of a standard barrier is often pressed against the ceiling, and the resultant frictional force at the floor and ceiling keeps the barrier in place. Perhaps less-desirable from the standpoint of labor and debris, a channel or furring strip may be attached to the ceiling to receive the upper end of a standard panel. A drop ceiling presents a unique problem because effective upward force cannot be applied to the drop ceiling. FIG. 8-11 show an embodiment of clip 54 that is useful for attaching a ceiling channel 30 to one of the grids 52 upon which rest the ceiling panels 53 of a suspended/drop ceiling. A typical ceiling grid piece 52 has a T shape cross section and a flat base. A channel 30 has a downward-facing concavity that is shaped to receive the upper end of a barrier 20. See FIG. 9. The typical grid piece has opposing lengthwise edges which are releasably grasped by a clip of the present invention. See FIG. 10.

Figure 10:
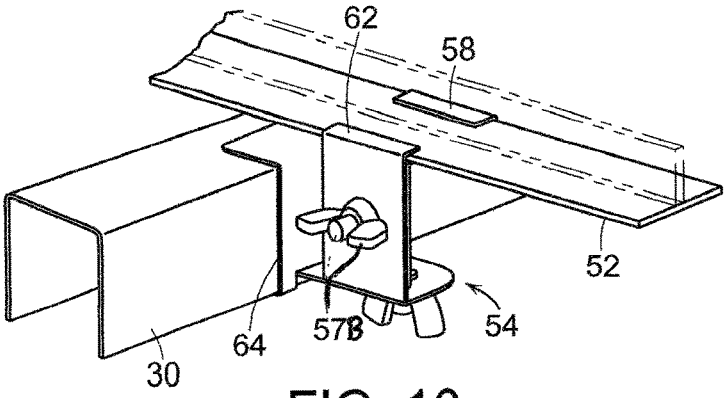
FIG. 10 is a perspective view of a portion of parts which comprise the assembly of FIG. 8, showing how a clip holds a ceiling channel fast to the grid piece of a drop ceiling.
Figure 11:
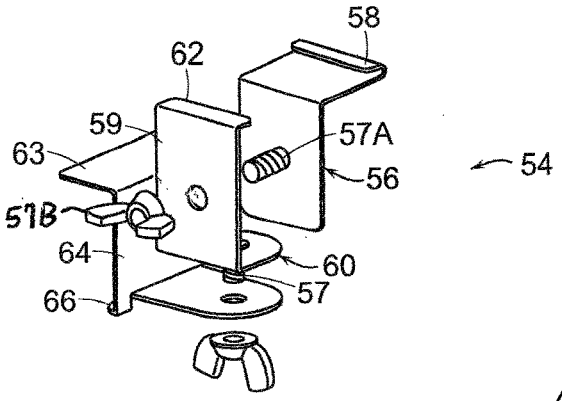
FIG. 11 is an exploded view of the clip which is shown in FIG. 10.

Referring mostly to FIG. 10 and FIG. 11, clip 54 comprises base 64 which is shaped for grasping the vertical edge of ceiling channel 30. Base 64 has a first grip portion 66 for grasping the lower edge of the channel, and a second grip portion 63 shaped to receive the upper part of a channel 30. A channel may be gripped by engaging the grip 66 with the edge of the channel and then rotating the channel about the channel length in the vertical plane. Support 59 is attached to base 64 by means of stub screw 57 and an associated wing nut. The upper edge of support 59 extends to an elevation above that of the top of the base, and the upper edge 62 of support 59 is shaped for griping a first lengthwise edge of a grid 52. Clip 54 further comprises clamp 56 which is connected to the support 59 by screw 57A and an associated wing nut 57B, which comprise the means for tightening the grip of a clip on a grid. In an alternative embodiment, the screw is attached to the support rather than to the clamp.

Clamp 56 has at its upper edge a grip 58, shaped for gripping a second lengthwise edge of grid 52. Thus when nut 57B is tightened, the grip portions of the clamp and of the support capture the opposing edges of the grid. When the screw is loosed, the clip can be removed from the grid. Preferably, the dimensions of the support and base where they are attached by vertical screw 57 are such that the body may be rotated in the horizontal plane relative to the support and clamp when the screw is loosened, to enable clamping of the grip portions of a clip to a grid which runs at an other-than-90 degree angle to the length of wall comprised of barriers.

Figure 8:
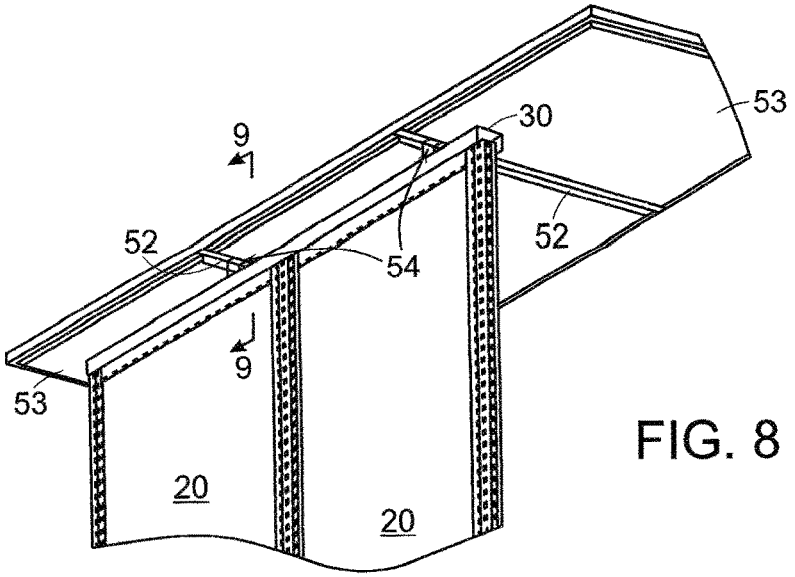
FIG. 8 is a perspective view looking upwardly at a portion of ceiling, showing how two barriers are engaged with the ceiling.
Figure 9:
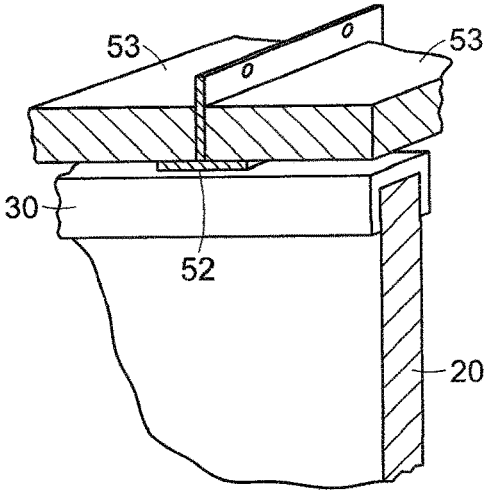
FIG. 9 is a detail sectional view of a portion of the assembly shown in FIG. 8.

A ceiling channel 30 may be attached to a multiplicity of grids that are spaced apart as shown in FIG. 8. FIG. 8 shows two barriers 20 having their upper ends engaged with a ceiling channel 30 that is held in place by two clips 54. The clip may be used with other barriers than barriers 20 of the present invention.

Figure 12:
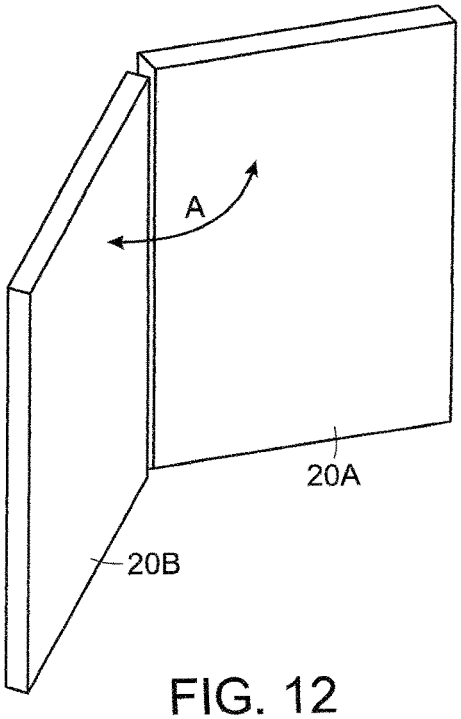
FIG. 12 is schematic perspective view showing how a first barrier panel attaches to a second barrier panel with an adjustable angle A therebetween.
Figure 13:
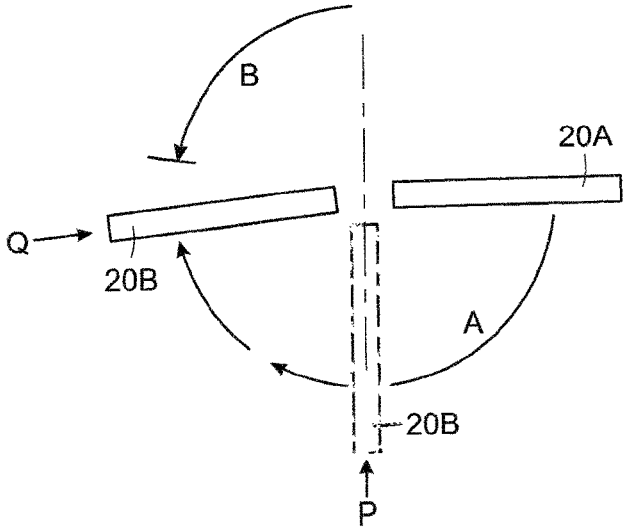
FIG. 13 is a schematic top view related to FIG. 12.

FIG. 12 and FIG. 13 are schematic pictures, to illustrate the problem being solved by the invention which comprises a hinge, which will be described next. In the perspective view of FIG. 12 and the top view of FIG. 13, it is desired to have an adjustable angle A between two adjacent barriers 20A, 20B. For example, in FIG. 13, angle A may be between 90 degrees (location P, where barrier 20B is shown in phantom) and about 175 degrees (location Q). A further aim is to enable the option of having a wall with barriers that angle in the mirror direction of angle A, namely, so panel 20A may move within at least the range indicated by arrow/angle B in FIG. 13; that angle is loosely called the mirror angle here. The challenge is how to carry out those aims when the barriers which are hinge-connected comprise a lower panel and a slidably movable upper panel, and when the barrier has an overall height (length) which varies with use, from one job to the next. Further, a good hinge blocks migration of airborne particulate through the hinge joint. A desirable hinge assembly should be conveniently engageable and disengageable from a standard barrier; it should have a reasonable cost of manufacture and good durability. The hinge assembly, described next, largely achieves those aims. As will be understood, when installed in a first fashion, the hinge assembly enables angling of adjacent barriers within on angle range, e.g., about 175 to about 90 degrees, and when turned "upside down" relative to the first fashion, the hinge assembly enables mirror-angling.

In the following discussion, for purpose of illustrating the functional connection between the mated barriers that hinge assemblies of the invention provide, it may sometimes be said that one barrier may be rotated or pivoted, or are angularly movable, relative to another barrier. However, the hinge assemblies described herein are not intended to provide for continual angular movement of one barrier relative to another during use. Once the interconnected barriers are adjusted for desired selected angles they will be static, absent strange circumstances.

Figure 14:
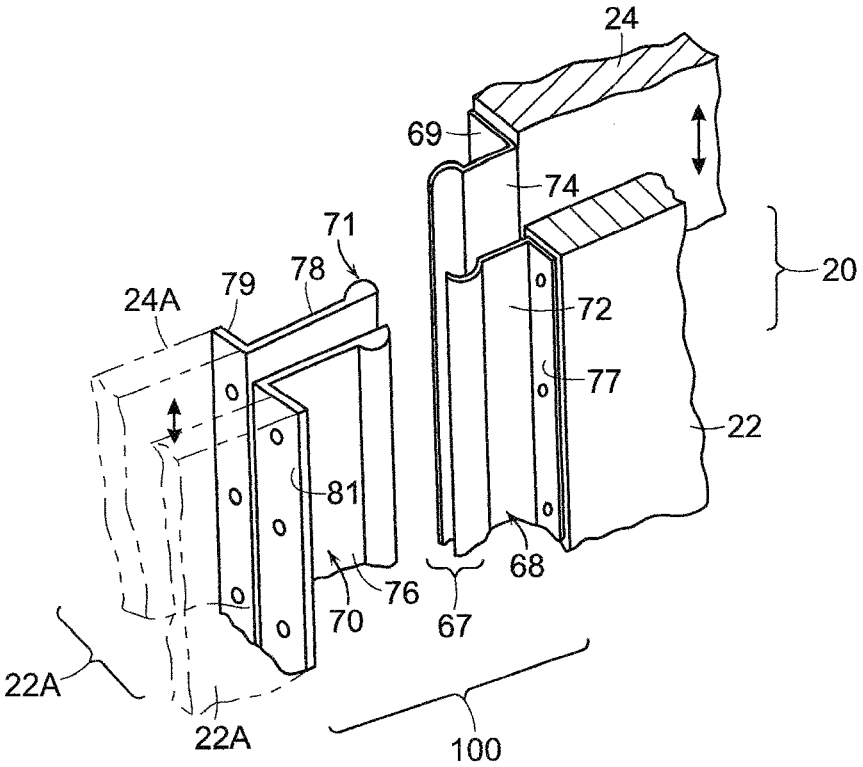
FIG. 14 is an exploded view of the hinge joint assembly between a first two-panel barrier and a second two-panel barrier, shown in phantom.
Figure 15:
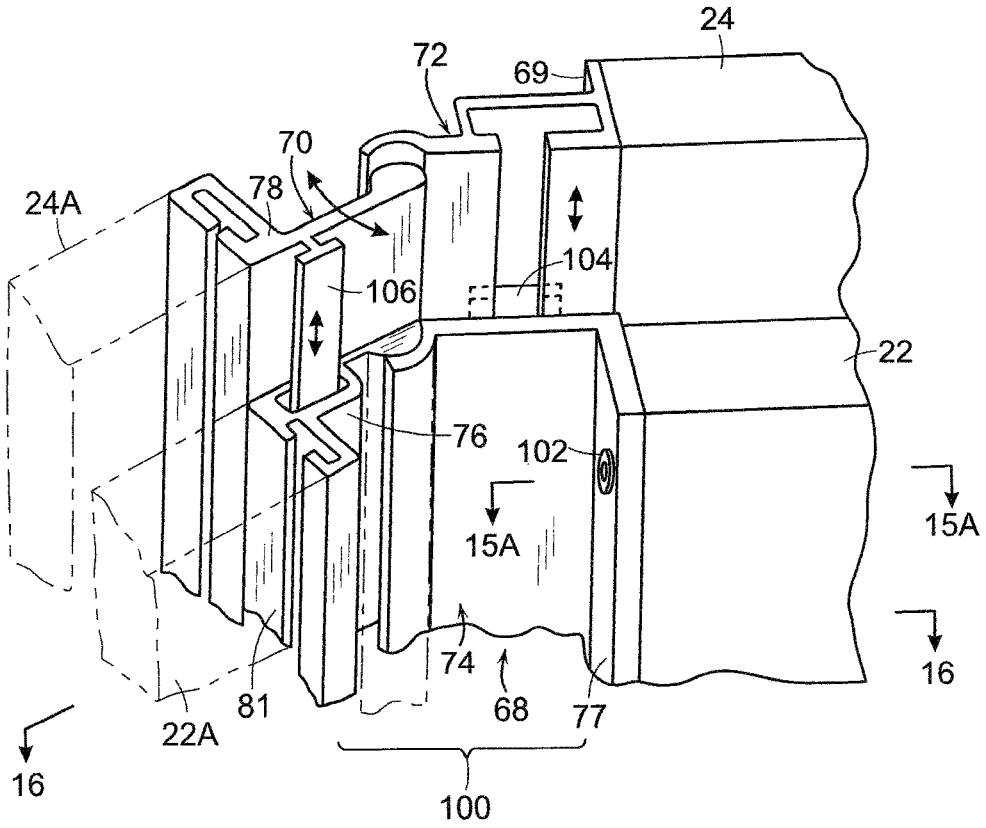
FIG. 15 is a partial perspective view of a hinge assembly that connects two barriers, each comprised of two panels. One barrier is shown in phantom.
Figure 16:
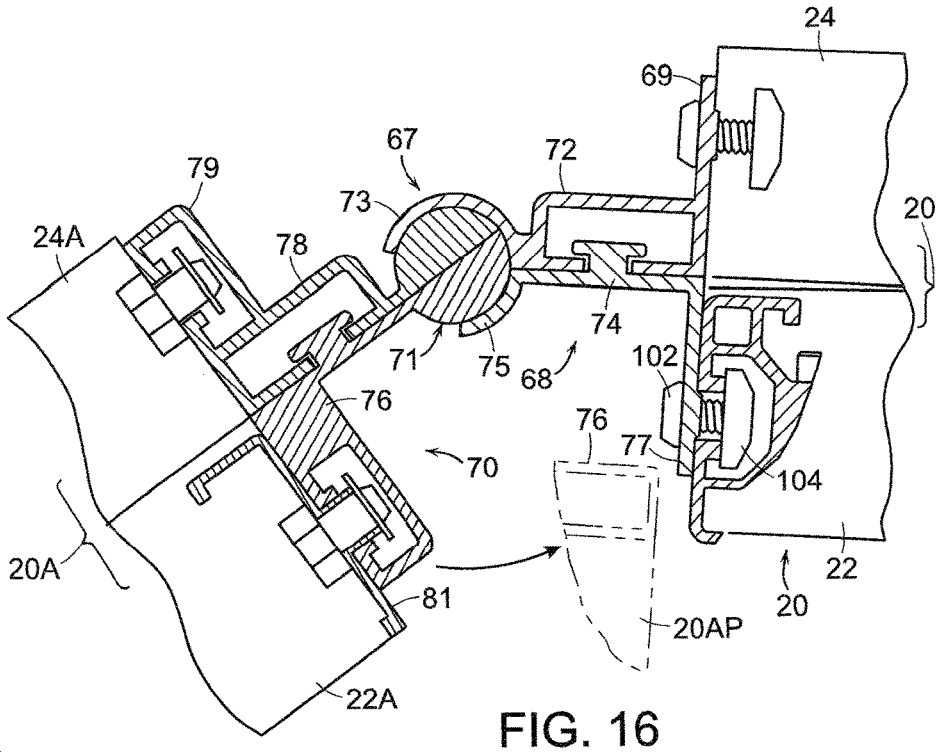
FIG. 16 is a horizontal cross section through the hinge assembly of FIG. 15.
Figure 17:
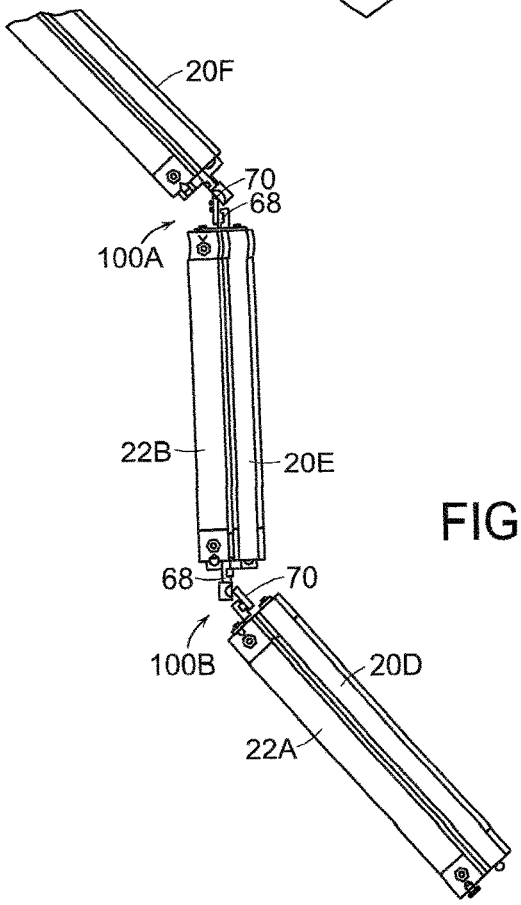
FIG. 17 is a top view showing a wall system comprised of three panels that are connected by two hinge assemblies of FIG. 16, each hinge assembly having a vertical orientation different from the other hinge assembly.

FIG. 14, 14A, 14B illustrate the principles of the hinge assembly of the present invention. FIG. 14, 14A, 14B are schematic/semi-schematic. FIG. 15 is a partial perspective representational view of a hinge assembly. FIG. 16 is a horizontal cross section through the hinge assembly 100 of FIG. 15. FIG. 17 shows three panels interconnected by hinge assemblies 100.

Figure 14A:
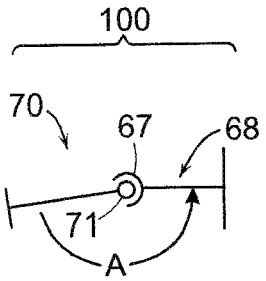
FIG. 14A is a schematic "stick-figure" top view of the joint between two barriers, to illustrate essential features of a vertical hinge which connects two barriers.
Figure 14B:
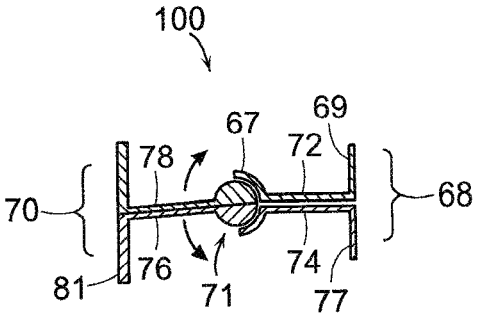
FIG. 14B is a semi-schematic view like FIG. 14B, showing more detail of the hinge parts.

FIG. 14A is schematic "stick view" looking downwardly on a hinge assembly 100 comprised of a male part 70 and female part 68. Male part 70 comprises pintle 71. Female part 68 comprises gudgeon 67 which is shaped to receive and hold pintle 71. As described below, an exemplary hinge assembly 100 enables a first two-panel barrier to be attached to one of part 68 or part 70, to swing to an angle A of 90 to 175 degrees relative to the plane of a second two-panel barrier, to which is attached the other part of the hinge assembly. The need to have the pintle captured laterally within the clasp of a gudgeon limits what angle A can be. FIG. 14B shows more detail; it is a semi-schematic view of the male part 70 and female part 68. Each part is respectively comprised of two pieces 76, 78 and 72, 74. The two pieces of each part mate at respective center planes, and the pieces or each part slide vertically relative to each other along those planes during use of the hinge assembly.

FIG. 14 is a perspective view, still-simplified, showing hinge assembly 100 in partially exploded form. FIG. 14 shows how, when the pintle and gudgeon are engaged with each other, the hinge assembly enables the two panels of each interconnected barrier to move vertically relative to one another. That is a feature of the two piece construction of each the male part and female part of the hinge assembly.

Referring to FIG. 14, the male and female parts 68, 70 of the assembly are respectively attached to the two panels of barriers 22A, 22, to hinge connect them. The first piece 78 of male part 70 has a flange 79 by which it is attached to the movable upper panel 24A and the second piece 76 of male part 70 has a flange 81 by which it is attached to the lower panel 22A of barrier 20A, both panels shown in phantom. It will be appreciated that the two-piece construction of the male part enables the upper panel 24A to be located at a vertical height of choice relative to the lower panel 22A. Similarly, the female part 68 of hinge assembly 100 comprises a first piece 74 that is connected by flange 69 to the movable upper panel 24, and a second piece 72 that is connected by flange 77 to the lower panel 22 of barrier 20. Again, the two-piece construction of female part 68 enables the panels 22, 24 to move vertically relative to each other.

Figure 15A:
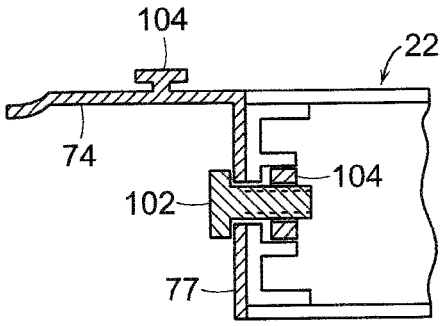
FIG. 15A is a horizontal cross section through a portion of the hinge assembly and one panel or one barrier, shown in FIG. 15.

Consistent with the Figures just discussed, an exemplary hinge assembly 100, along with panels, is shown in the perspective view of FIG. 15. FIG. 16 is a horizontal cross section through the assembly of FIG. 15. FIG. 15A is a detail of a part of the cross section.

FIG. 15 and FIG. 16 illustrate how female part 68 is comprised of two pieces 72, 74 which are slidably captured to each other by means of a tee cross section rail 104 that extends from piece 74 and captured within a slot of piece 72. Thus the upper panel 24 which is attached to piece 72 at flange 69 can move vertically relative to the lower panel 22 which is attached to piece 74 at flange 77. The mating cantilever portions of the two pieces 72, 74 form the vertically-running cavity of gudgeon 67 wherever the cantilever portions overlap in the vertical direction. With respect to the tee and mating groove: in alternative embodiments of hinge 100, pieces 72, 76 may comprise a rail (tee shape or otherwise) and the mating pieces may comprise a groove; and other cross section rails and mating grooves may be used, as suggested above in connection with alternative slides for overlapping panels. For example, see FIGS. 4D and 4E, previously discussed.

Correspondingly, FIG. 15 shows how male part 70 is comprised of second piece 76 and first piece 78 which are respectively attached to lower panel 22A and upper panel 24A. The first piece 78 and second piece 76 are slidably connected to each other where tee 106 of piece 78 slides in the vertical slot of second piece 76. The mating cantilever portions of the two pieces 76, 78 form pintle 71, wherever the portions overlap in the vertical direction. Pintle 71 is received and pivotable in gudgeon 67.

As will be appreciated by study of FIG. 15 and FIG. 16 and the other Figures, and the further description here, if the upper panel 24 is lifted relative to the lower panel 22, it lifts the piece 72 of the female part 68 of the hinge assembly relative to the piece 74 of the female part 68. If panel 24A is also lifted to the same elevation as panel 24 (as will be common), the piece 78 of the male part 70 of the hinge assembly will also be lifted. Thus only half of the gudgeon and only half of the pintle will be in contact with the mating pintle and gudgeon, in the region where the panels 24, 24A extend above the panels 22, 22A. The same kind of partial engagement characterizes the hinge assembly at the portions of the lower panels which are beneath the elevation where there is overlap by the upper panels.

Those "half engagements" nonetheless, in cooperation with the engagement along the length of the hinge assembly where there are full-shape pintle and full-shape gudgeon, keeps the two panels of hinge-joined barriers engaged with each other, and also seals the space between the panels 24 and 24A, and between panels 22 and 22A, against passage of airborne particulate, etc.

The arrow in FIG. 16 illustrates how barrier 20A can rotate, so it is at an essentially right angle to barrier 20, as indicated by the phantom barrier portion 20AP. That motion is enabled by rotation of pintle 71 within gudgeon 67. Note how the shape of gudgeon portion 75 enables an about 90 degree angle to be formed between the barriers in this embodiment. The mating portions 73, 75 of the gudgeon have to have sufficient curved lengths so that the pintle is captured within the "claws" of the gudgeon. In a preferred embodiment like that illustrated, the opening between the "claw ends" is an arc of about 175 degrees, which is sufficient for capturing purpose. That limits the rotation motion of the barrier 20A to a near 175 degree included angle to barrier 20. Where a preferred about 175 degree arc of rotation lies, relative to the plane of the surface of a barrier 20 is a matter of design choice.

FIGS. 15, 15A and 16 exemplarily show how the hinge assembly parts attach to the panels of barriers 20, 20A. Screw 102 engages a nut 104 that is captured within the frame of panel 22 of barrier 20. With reference to the description here and that attending FIG. 3, the hinge assemblies may alternatively have fixed screws which engage slots 28 in the sides of panels 22, 24 of a barrier 20. Alternatively, the hinge assemblies may have slots which engage fixed screws on the sides of the panels of a barrier.

It will be appreciated that the same hinge assembly 100 may be used to connect two barriers so they can range in exemplary angle A that is between about 90 to about 175 degrees as just described. Alternatively, suppose hinge assembly 100 is turned upside down from the way it is pictured in the foregoing FIGS. 12, 13, 15 and 17, and it is then attached to two abutting barriers. Doing that will enable an angle A that is between about 185 degrees and about 270 degrees (which is the same as angle B in FIG. 13). So, for example, the female part 68 in FIG. 16 then would be attached to the barrier 20A, on the left, and the male part 70 then would be attached to the barrier 20, on the right. (Of course, in another alternative, a 180 degree angle between barriers is obtained by simply connecting two barriers without the use of a hinge.)

FIG. 17 shows three interconnected barriers 20D, 20E, 20F in top view. Barriers 20F and 20E are connected by hinge assembly 100A, oriented as described in FIG. 15 and FIG. 16. Barriers 20D and 20E are connected by a hinge assembly 100B which is upside down from assembly 100A. It will be understood that a multiplicity of planar-interconnected barriers, like those shown in FIG. 1, may be substituted for one or more of the single barriers shown in FIG. 17. Such a combination of one or more barriers which are rigidly connected by unhinged joints (such as the joint described in connection with FIG. 3, or an alternative) are called here a barrier planar set.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A wall system for partitioning a building space having a floor surface, a ceiling, a ceiling height, and at least one vertical wall, comprising:

a first barrier having a length and a second barrier having a length, said lengths mutually parallel to each other, said barriers interconnected by a hinge assembly;

each of the first and second barriers comprised of at least two overlapping panels which are slideable relative to each other for changing the length of the barrier to fit within the ceiling height of the building space;

the hinge assembly connecting the first barrier and the second barrier so the barriers can be angled relative to each other in a plane transverse to the first or second barrier length, the hinge assembly comprising:

a female part having a gudgeon attached to the first barrier, the female part comprised of two female mating pieces which are slidable relative to each other in a direction of the first barrier length, wherein one of said female mating pieces is attached to the first panel of the first barrier and the other one of said female mating pieces is attached to the second panel of the first barrier; and a male part having a pintle attached to the second barrier, the male part comprised of two male mating pieces which are slidable relative to each other in a direction of the second barrier length, wherein one of said male mating pieces is attached to the second panel of the second barrier and the other one of said mating pieces is attached to the first panel of the second barrier;

wherein the pintle is positioned within the gudgeon for angular pivoting of the male part relative to the female part, and thereby pivoting of the first barrier relative to the second barrier.

2. The wall system of claim 1 wherein the two female pieces are slidably engaged with each other by a combination of a T shape rail mounted on one of the two female pieces and a groove in the other one of the two female pieces.

3. The wall system of claim 1 wherein the two male pieces are slidably engaged with each other by a combination of a T shape rail mounted on one of the two male pieces and a groove in the other one of the two male pieces.

4. A wall system, for partitioning a building space having a floor, a ceiling, a ceiling height, and at least one vertical wall, comprising:

a first barrier and a second barrier interconnected to each other by a hinge assembly;

each of the first and second barriers having a changeable length for fitting within said ceiling height of the building space, each of the first and second barriers having a first lengthwise edge and an opposing second lengthwise edge, each of the first and second barriers comprising a first panel and a second panel mated to the first panel;

each panel having a rectangular shape, a length, and opposing lengthwise edges corresponding with the edges of a respective one of the barriers;

said panels mated to each other in an overlapping and slideable configuration, said hinge assembly having a lengthwise hinge axis that is parallel to the lengthwise edges of each of the first and second barriers and connected to the first barrier and second barrier to enable said barriers to be angled relative to each other through a range of angling in a plane transverse to said changeable length, the hinge assembly comprising:

a female part having a gudgeon attached to the first barrier;

a male part having a pintle attached to the second barrier;

wherein the pintle is positioned within the gudgeon, so the female part and the male part are connected for angular pivoting of said parts and thereby of said first and second barriers;

wherein said female part comprises a first piece and a second piece, the first piece slidably mated with the second piece for relative motion parallel to said lengthwise hinge axis, the first piece having a flange portion attached to the first panel of the first barrier and the second piece having a flange portion attached to the second panel of the first barrier; and wherein said male part comprises a first piece and a second piece, the first piece slidably mated with the second piece for relative motion parallel to said lengthwise hinge axis, the first piece having a flange portion attached to the first panel of the second barrier and the second piece having a flange portion attached to the second panel of the second barrier.

5. The wall system of claim 4 further comprising an additional barrier, the additional barrier identical to the first barrier or the second barrier; and a second hinge assembly identical to the hinge assembly which connects the first barrier and the second barrier, the second hinge assembly connecting the additional barrier to a lengthwise edge of either the first barrier or the second barrier.

6. The wall system of claim 4 wherein the range of angling between the first barrier and the second barrier is between about 90 and 175 degrees.

7. The wall system of claim 4 further comprising:

a third barrier identical to the first barrier or the second barrier; and a second hinge assembly identical to the hinge assembly that connects the first barrier to the second barrier, the second hinge assembly connecting the third barrier to either the second barrier or the first barrier;

wherein the first barrier is at a first angle to the second barrier and the third barrier is at a second angle to the second barrier, both said first and second angles within a plane transverse to said changeable length.

8. The wall system of claim 4 wherein the first piece and the second piece of the female part of the hinge assembly are slidably engaged with each other by a combination of a T shape rail attached to the first piece and a groove in the second piece; and wherein the first piece and the second piece of the male part are slidably engaged with each other by a combination of a T shape rail attached to the first piece and a groove in the second piece.

9. The wall system of claim 4 wherein each of the panels further comprises:

a plurality of pins on a first of the opposing lengthwise edges of the panel, each pin extending perpendicular to the first lengthwise edge of the panel, each pin comprising a shank having a width and a head having a width, wherein the width of the head is greater than the width of the shank; and a plurality of slots on a second of the opposing lengthwise edges of the panel, each slot having a width which is both larger than the width of said shank and smaller than the width of said head, each slot further having a central opening portion which is larger than the width of said head; and wherein the flange portions of each of said female parts and male parts comprise a plurality of slots and/or pins which are respectively matable with and engaged with either or both of said pins and/or slots of said barriers.

10. The wall system of claim 9 further comprising a third barrier identical to the first barrier and the second barrier, wherein the pins and/or slots on the second lengthwise edge of the second barrier are positioned within the slots and/or pins of a lengthwise edge of the third barrier, to thereby form said wall system wherein at least two adjacent barriers of said first, second and third barriers are fixedly attached to each other and two adjacent barriers of said first, second and third barriers are connected by said hinge assembly.

11. The wall system of claim 4, further comprising:

a filler barrier connected to an unhinged lengthwise edge of the opposing first and second lengthwise edges of either the second barrier or the first barrier, the filler barrier having a length which corresponds with a selected one of the changeable lengths of at least one of the first barrier or the second barrier;

the filler barrier comprising:

at least one frame attached to said unhinged lengthwise edge; and a filler panel comprised of one or more pieces, the filler panel having a length, opposing substantially planar surfaces, a thickness a first lengthwise edge and an opposing second lengthwise edge, wherein at least a portion of a first lengthwise edge of the filler panel is captured within the at least one frame;

wherein the at least one frame comprises a combination of a channel and a shoe and has an adjustable length, (a) said channel having a length, a flange for attachment to the edge of the first panel of said second barrier or of said first barrier, and a pair of legs extending lengthwise parallel to said substantially planar surface of the filler panel, the legs spaced part sufficiently to provide a space for receiving said shoe;

(b) said shoe having a length, a flange for attachment to the edge of a second panel of said second barrier or of said first barrier, and a pair of legs extending lengthwise parallel to said substantially planar surface of the filler panel, the legs spaced apart sufficiently to provide a space from receiving the thickness of the filler panel;

wherein the shoe is slidably positioned within the legs of the channel;

wherein the filler panel length is greater than the length of the longer of the length of the channel or the length of the shoe, and wherein said first lengthwise edge of the filler panel is positioned within both the space between the legs of the shoe and the space between the legs of the channel; and wherein the channel is attached to the either the first panel or the second panel of the first barrier or the second barrier, and wherein the shoe is attached to the second panel of the same barrier.

12. The wall system of claim 4 wherein the first panel of either or both the first barrier and the second barrier is slidably attached to the second panel thereof by means for attaching which includes (a) spaced apart strips affixed to the first side of one of said panels, each strip having a T shape cross section portion, and (b) spaced apart grooves in the first side of the other of said two panels, wherein the T shape cross section portion of each strip is slidably captured in one of said grooves;

wherein at least one of the panels has on a first lengthwise edge a plurality of pins extending perpendicular to the length of the panel, each pin comprising a shank having a width and a head having a width, wherein the head width is greater than the shank width; and wherein said at least one of the panels has a plurality of slots on the second lengthwise edge, each slot having a width which is both larger than the width of said shank and smaller than the width of said head, each slot further having a central opening portion which is larger than the width of said head.

13. The wall system of claim 4 wherein one or both of the gudgeon and the pintle are formed of two mating lengthwise portions of a respective one of the first piece and the second piece of the gudgeon and pintle, the portions mating along a plane running parallel to the lengthwise axis of the hinge assembly.

* * * * *